US005470016A

United States Patent [19]

Ljungström et al.

[11] Patent Number: 5,470,016

[45] Date of Patent: Nov. 28, 1995

[54] REDUCIBLE VOLUME CONTAINERS

[76] Inventors: Tommy B. G. Ljungström, 532 Cherbourg Ct. South, Buffalo Grove, Ill. 60089; David Anchor, 407 S. Sunnyside, Itasca, Ill. 60143

[21] Appl. No.: 228,408

[22] Filed: Apr. 15, 1994

[51] Int. Cl.[6] ..... B65D 5/54

[52] U.S. Cl. ..... 229/101.1; 229/237; 229/240; 493/59; 493/63; 493/963

[58] Field of Search ..... 229/101.1, 101.2, 229/237, 240, 242; 493/59–61, 63, 963

[56] References Cited

U.S. PATENT DOCUMENTS

| | | | |
|---|---|---|---|
| 2,490,133 | 12/1949 | Inman | 229/101.1 |
| 2,969,902 | 1/1961 | Cage | 229/101.1 |
| 3,539,093 | 11/1970 | Massengill | 229/101.1 |
| 4,279,526 | 7/1981 | McMullan | 229/101.1 |
| 4,657,142 | 4/1987 | Mizoguchi et al. | 229/237 |
| 4,865,203 | 9/1989 | Ueda | 229/237 |
| 5,217,164 | 6/1993 | Sullivan | 229/101.1 |
| 5,234,123 | 8/1993 | Layre et al. | 229/237 |

FOREIGN PATENT DOCUMENTS

| | | | |
|---|---|---|---|
| 23411 | 2/1981 | European Pat. Off. | 229/101.1 |
| 137077 | 10/1979 | Japan | 229/101.1 |

*Primary Examiner*—Gary E. Elkins

[57] ABSTRACT

A reducible volume container includes a package wall having an interior surface and an exterior surface, with at least one tear strip formed in the package wall. The tear strip is defined by a pair of generally parallel frangible tear lines. Each tear line includes a pair of generally parallel creases formed on the interior surface of the package wall, and a linear cut formed in the exterior of the package wall. The linear cut is disposed in an area between the parallel creases and has a depth extending only partly through the thickness of the package wall.

20 Claims, 2 Drawing Sheets

REDUCIBLE VOLUME CONTAINERS

TECHNICAL FIELD

The present invention relates generally to reducible volume containers. The present invention relates specifically to reducible volume containers having a plurality of tear strips.

BACKGROUND

For many years, a variety of solid and semi-solid products have been packed and sold in disposable or "one-trip" containers. A recurring problem with such products so packed is that the volume of a conventional package is fixed, while the volume of the product contained diminishes as the product is consumed.

One well-known solution to this problem is to provide a reducible volume container. In such containers, the consumer removes portions of the package as he or she uses the product, so that the volume of the container diminishes with the volume of the product. Reducible volume containers have been proposed in the form of cartons having walls that are adapted to be stripped away in successive sections. Examples of such cartons are shown in the following U.S. Pat. No. 2,490,133 to Inman; U.S. Pat. No. 3,967,773 to Kaufmann; U.S. Pat. No. 4,349,110 to Hayashi; U.S. Pat. No. 4,762,233 to Sears; and U.S. Pat. No. 5,217,164 to Sullivan. Generally, these patents show cartons in which tear strips are defined by providing the carton material with weakened areas, usually in the form of lateral score lines. The tear strips terminate in some sort of tab element to be grasped by the consumer, who proceeds to remove the strips, as required, by tearing along the score lines.

Although the concept of reducible volume cartons has obvious appeal, such cartons in known configurations have not met with widespread consumer acceptance. One reason for the lack of success may be the nature of the tear strips themselves. In known reducible volume containers, the tearing process for the strips is frequently difficult to begin and unpredictable. The tab elements of the tear strips are often difficult to locate and grasp. Further, unless the consumer takes great care to tear the strip straightly and precisely along the score line, the strip has a tendency to tear across itself. When the strip tears across itself, the consumer must attempt to start and completely tear the strip adjacent to the malfunctioning strip. This renders further opening of the carton difficult at best.

It can thus be seen that the need exists for a reducible volume container in which tear strips are easy to locate and grasp, with some mechanism for lessening the tendency of tear strips to tear across themselves.

SUMMARY OF THE INVENTION

These and other objects are achieved in the present invention, which provides a reducible volume container including a package wall having an interior surface and an exterior surface, with at least one tear strip formed in the package wall. The tear strip is defined by a pair of generally parallel frangible tear lines. Each tear line includes a pair of generally parallel creases formed on the interior surface of the package wall, and a linear cut formed in the exterior of the package wall. The linear cut is disposed in an area between the parallel creases and has a depth extending only partly through the thickness of the package wall.

In an embodiment, the package wall can be formed from a laminated material. The laminated material can include, from the exterior to the interior surface of the package wall, the following layers: an exterior LDPE layer; a paperboard layer adjacent to the exterior LDPE layer; an internal LDPE layer adjacent to the paperboard layer; a barrier layer adjacent to the internal LDPE layer; and a interior contact layer adjacent to the barrier layer. The parallel creases of the tear line can extend into the barrier layer, and the depth of the linear cut can extend from the exterior surface of the package wall to a point just short of the barrier layer. The barrier layer can be provided as an aluminum foil layer, or any other suitable barrier material, e.g. EVOH.

Other objects and advantages of the present invention will become apparent upon reference to the accompanying description when taken in conjunction with the following drawings.

DETAILED DESCRIPTION OF THE PREFERRED EMBODIMENTS

Figure 1:
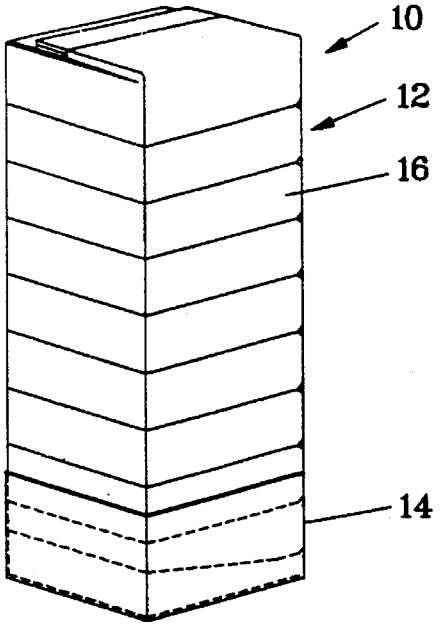
FIG. 1 illustrates a perspective view of a reducible volume container and cap embodying the principles of the present invention.

FIG. 1 illustrates a reducible volume canon assembly 10 constructed in accordance with the principles of the present invention. The carton assembly 10 includes a reducible volume container 12 and a fitted cap 14.

Figure 2:
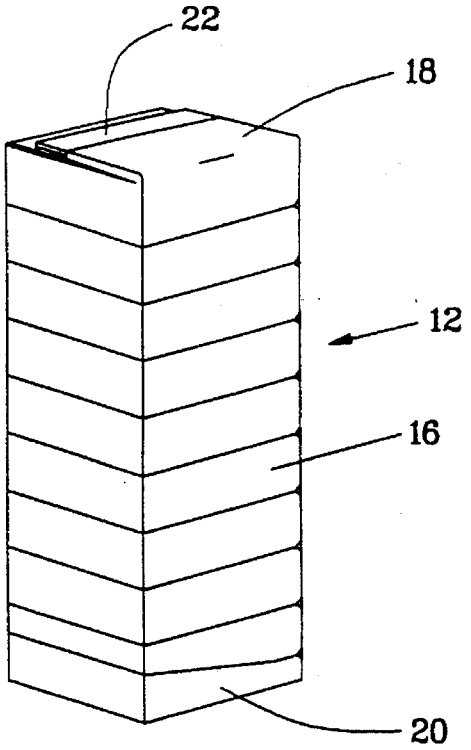
FIG. 2 illustrates a perspective view of the carton illustrated in FIG. 1, with the cap removed.

The container 12 is made up of a series of tear strips 16. As illustrated in FIG. 2, the tear strips 16 are disposed between a top end piece 18 and a bottom end piece 20 of the container 12. Except for the presence of the tear strips 16, the container 12 is in most respects similar to a so-called "flat top" container, with a top fin 22 bent towards and sealed to the top end piece 18. Those of skill in the art will recognize that the container 12 can be formed, filled, and sealed in much the same way as a typical flat-top container.

Figure 3:
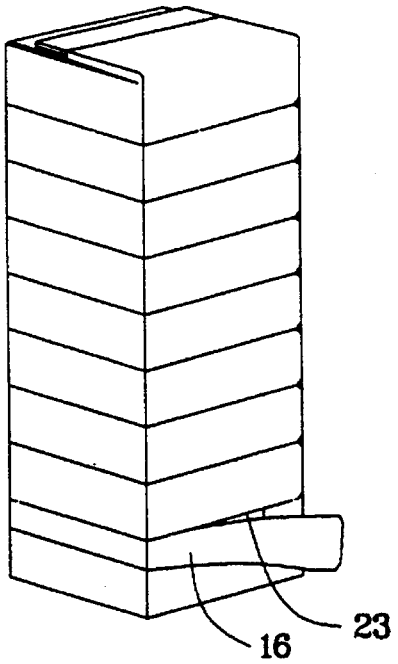
FIG. 3 illustrates a perspective view of the carton illustrated in FIG. 1, with a tear strip partially removed.

As illustrated in FIG. 3, the tear strips 16 are removed one at a time to expose the solid or semi-solid product 23 held in the container 12. Once a tear strip 16 has been peeled away, the exposed product can be removed (for example, by cutting) from the remaining product. After the exposed product has been removed, the cap 14 can be replaced to preserve the cleanliness and freshness of the remaining product.

Figure 4:
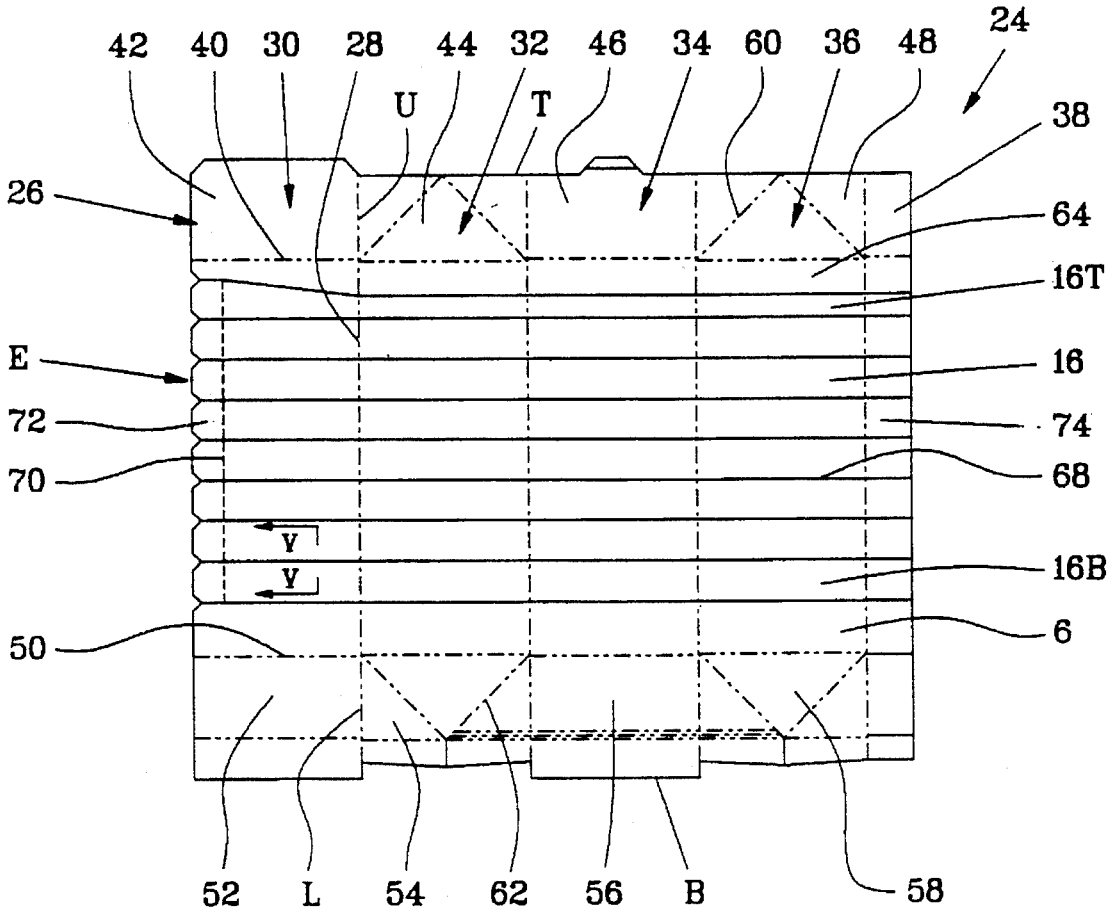
FIG. 4 illustrates a plan view of a carton blank.

A reducible volume container such as that shown in FIGS. 1–3 can be formed using a carton blank 24 as illustrated in FIG. 4. The blank 24 includes a carton body 26 divided by a plurality of vertical creases 28. The vertical creases 28 extend from the top T to the bottom B of the carton blank 24, and separate the carton blank 24 into first (30), second (32), third (34), fourth (36), and fifth (38) vertical panels.

A horizontal top crease 40 extends substantially between the sides of the carton blank 24. The top crease 40 intersects with the vertical creases 28 to define first (42), second (44), third (46), and fourth (48) top flaps between the horizontal top crease 40 and the top T of the carton blank 24, with the top flaps separated from one another by upper portions U of the vertical creases 28. A horizontal bottom crease 50 extends substantially between the sides of the carton blank 24 at a position directly below side strip 66 of the carton blank 24. The bottom crease 50 intersects with the vertical creases 28 to define first (52), second (54), third (56), and fourth (58) bottom flaps between the horizontal bottom crease 50 and the bottom B of the carton blank 24. The bottom flaps are separated from one another by lower portions L of the vertical creases 28.

A series of top diagonal creases 60 are formed on the second top flap 44 and the fourth top flap 46 of the carton blank 24. The top diagonal creases 60 enable the second and fourth top flaps to be folded inwardly toward one another during carton formation, thus causing the first top flap 42 and third top flap 46 to become the exposed top surface of the top end piece 20 of the finished carton.

A series of bottom diagonal creases 62 are formed on the second bottom flap 54 and the fourth bottom flap 58 of the carton blank 24. The bottom diagonal creases 62 enable the second and fourth bottom flaps to be folded inwardly toward one another during carton formation, while the first bottom flap 52 and the third bottom flap 56 become the major flaps that form the exposed bottom surface of the bottom end piece 20 of the finished carton.

A top side strip 64 is disposed between a top tear strip 16T and the horizontal top crease 40. The top side strip 64 becomes the four sides of the top end piece 18 of the finished carton.

A bottom side strip 66 is disposed between a bottom tear strip 16B and the horizontal bottom crease 50. The bottom side strip 66 becomes the four sides of the bottom end piece 18 of the finished carton. The tear strips 16 are separated from one another, and from the side strips 64, 66, by a series of frangible tear lines 68.

A tab crease 70 extends through all of the tear strips 16 at a location between the vertical crease 28 separating the first panel 30 from the second panel 32, and the edge E of the blank body 26. The tab crease 70 defines the inner limits of a plurality of tab members 72. The tab members 72 are grasped by the user of the carton when removing the tear strips 16 to expose product. An area of suitable adhesive 74 may be provided on the fifth panel 38. The adhesive 74 weakens the bond between the tab members 70 and the fifth panel 38, thus rendering the tab members easier to grasp.

Figure 5:
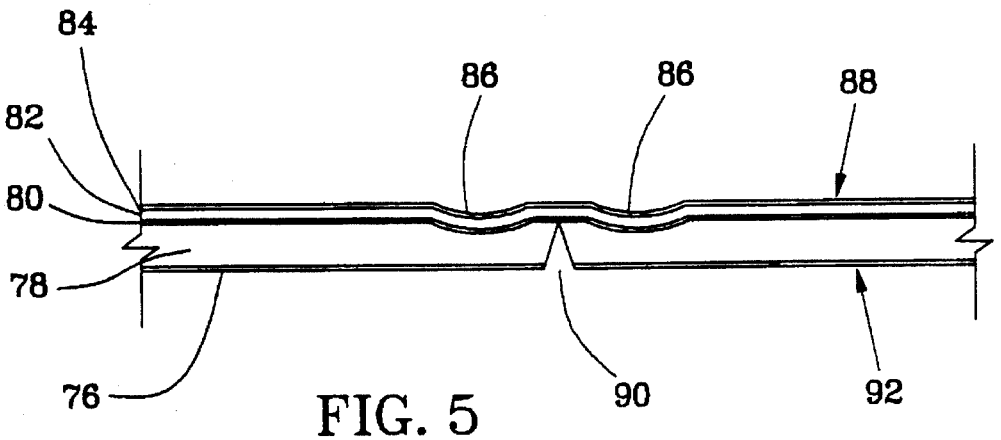
FIG. 5 illustrates a detailed sectional view taken generally along line V—V of FIG. 4.

As shown in detail in FIG. 5, the carton blank 24 is a laminated material. The illustrated laminate includes the following layers: an outer LDPE layer 76; a paperboard layer 78, an internal LDPE layer 80 adjacent to the paperboard layer 78; a barrier layer 82 adjacent to the internal LDPE layer 80; and an interior product contact layer 84 adjacent to the barrier layer 82. The barrier layer 82 may be chosen to suit the product to be packed in the container. The inventors presently contemplate aluminum foil as an advantageous barrier material, but also recognize the utility of non-foil barrier materials such as EVOH. The inner product contact layer 84 can be provided as and LDPE layer. However, it has long been recognized that LDPE has a tendency to "scalp", or absorb, essential oils and flavors in some products. Thus, a thin layer of LDPE, or a non-scalping contact layer, should be employed. Those of skill in the art will also recognize that it may be advantageous to provide one or more tie layers of adhesive material between the other layers.

Each of the frangible tear lines 68 includes a pair of parallel depressions or creases 86 impressed into the interior side 88 of the carton body 26. The creases 86 are impressed deeply enough into the interior surface 88 of the blank body 26 so that the barrier layer 82 is deformed, i.e. the parallel creases 86 of the tear line 68 extend into the barrier layer 82.

A linear cut 90 is formed in the exterior side 92 of the carton body 26. The linear cut 90 is disposed in an area between the pair of parallel creases 86, and is parallel to the creases 86. The cut 90 has a depth that extends only partly through the thickness of the carton body 26, preferably extending from the exterior surface 92 of the carton body 26 to a point just short of the barrier layer 82.

When the blank 24 is formed into a container 12 as shown in FIG. 1, the interior side 88 of the blank body 26 becomes the interior of the container 12.

Although the present invention has been described with reference to a specific embodiment, those of skill in the art will recognize that changes may be made thereto without departing from the scope and spirit of the invention as set forth in the appended claims.

We claim:

1. A package comprising:

a package wall having an interior surface and an exterior surface; and at least one tear strip formed in the package wall, the tear strip being defined by a pair of generally parallel frangible tear lines;

wherein each tear line includes a pair of generally parallel creases formed on the interior surface of the package wall, and a linear cut formed in the exterior of the package wall, with the linear cut disposed in an area between the parallel creases and having a depth extending only partly through the thickness of the package wall.

2. A package according to claim 1, wherein the package wall comprises a laminated material.

3. A package according to claim 2, wherein the laminated material comprises, from the exterior to the interior surface of the package wall, the following package layers:

an exterior LDPE layer;

a paperboard layer adjacent to the exterior LDPE layer;

an internal LDPE layer adjacent to the paperboard layer;

a barrier layer adjacent to the internal LDPE layer; and an interior contact layer adjacent to the barrier layer.

4. A package according to claim 3, wherein the parallel creases of the tear line extend into the barrier layer.

5. A package according to claim 4, wherein the depth of the linear cut extends from the exterior surface of the package wall to a point just short of the barrier layer.

6. A package according to claim 5, wherein the barrier layer comprises an aluminum foil layer.

7. A package according to claim 5, wherein the barrier layer comprises an EVOH layer.

8. A package according to claim 5, wherein the interior contact layer comprises an LDPE layer.

9. A package according to claim 3, further comprising at least one adhesive tie layer disposed between adjacent package layers.

10. A package according to claim 1, wherein each tear strip terminates in a respective tab member.

11. A package according to claim 10, wherein the package includes a lateral edge, and each tab member is disposed between a tab crease line and the lateral edge of the package.

12. A package according to claim 11, wherein each tab member is in sealing contact with a wall of the package, and an adhesive material is disposed between each tab member and the wall of the package.

13. A carton blank for forming a reducible volume container comprising the following:

a laminated blank body having a top and a bottom;

a plurality of bottom creases formed in the bottom of the blank body to define bottom flaps that are adapted to be folded and sealed to form a bottom surface of a finished carton, including a horizontal bottom crease extending substantially between the sides of the carton blank, defining first, second, third, and fourth bottom flaps between the horizontal bottom crease and the bottom of the carton blank, with the bottom flaps being separated from one another by lower portions of the vertical creases;

a plurality of top creases formed in the top of the blank body, the top creases defining top flaps that are adapted to be folded and sealed to form a top surface of a finished carton, including a horizontal top crease extending substantially between the sides of the carton blank, defining first, second, third, and fourth top flaps between the horizontal top crease and the top of the carton blank, with the top flaps being separated from one another by upper portions of the vertical creases;

a plurality of substantially equidistantly spaced vertical creases extending from the top of the carton blank to the bottom of the carton blank, separating the carton blank into first, second, third, fourth, and fifth vertical panels; and a plurality of tear strips disposed between the horizontal top crease and the horizontal bottom crease, with each of the tear strips being defined by a pair of generally parallel frangible tear lines;

wherein each tear line includes a pair of generally parallel creases formed on an interior surface of the carton blank, and a linear cut formed in an exterior surface of the carton blank, with the linear cut disposed in an area between the parallel creases and having a depth extending only partly through the thickness of the carton blank.

14. A carton blank according to claim 13, further comprising:

a top side strip disposed between a top tear strip and the horizontal top crease; and a bottom side strip disposed between a bottom tear strip and the horizontal bottom crease.

15. A carton blank according to claim 13, wherein each tear strip terminates in a respective tab member.

16. A carton blank according to claim 15, wherein the carton blank includes a lateral edge, and each tab member is disposed between a tab crease line and the lateral edge of the carton blank.

17. A carton blank according to claim 15, wherein each tab member is adapted for sealing contact with a surface of the fifth panel of the carton blank, and at least a portion of the surface of the fifth panel is coated with an adhesive material.

18. A carton blank according to claim 13, wherein the laminated material comprises the following layers:

an exterior LDPE layer;

a paperboard layer adjacent to the exterior LDPE layer;

an internal LDPE layer adjacent to the paperboard layer;

a barrier layer adjacent to the internal LDPE layer; and an interior contact layer adjacent to the barrier layer.

19. A carton blank according to claim 18, wherein the parallel creases of the tear line extend into the barrier layer, and the depth of the linear cut extends from the exterior surface of the package wall to a point just short of the barrier layer.

20. A method of making a carton blank comprising the following steps:

providing a laminated blank body having a top and a bottom;

forming a plurality of pairs of generally parallel creases on an interior surface of the carton blank; and forming a plurality of linear cuts in an exterior surface of the carton blank, with each linear cut disposed in an area between the parallel creases of each pair of parallel creases, each linear cut having a depth extending only partly through the thickness of the carton blank.

* * * * *

UNITED STATES PATENT AND TRADEMARK OFFICE

CERTIFICATE OF CORRECTION

PATENT NO. : 5,470,016

DATED : November 28, 1995

INVENTOR(S) : Ljungstrom, et al

It is certified that error appears in the above-indentified patent and that said Letters Patent is hereby corrected as shown below:

On the title page, item [73], Assignee: should read --Tetra Laval Holdings & Finance, S.A., Pully, Switzerland --

Before item [39]: Attorney, Agent, or Firm: Patrick N. Burkhart should be inserted.

Signed and Sealed this

Twenty-first Day of May, 1996

*Attest:*

Bruce Lehman

BRUCE LEHMAN

*Attesting Officer*

*Commissioner of Patents and Trademarks*